US007497740B2

(12) United States Patent
Mei et al.

(10) Patent No.: US 7,497,740 B2
(45) Date of Patent: Mar. 3, 2009

(54) TANDEM-CONNECTED ROTATABLE RECEPTACLE UNIT

(76) Inventors: Tzu-Chiang Mei, 5th Floor, No. 28, Alley 401, Lane 150, Hsin I Road, Sec. 5, Taipei City (TW); Da-Peng Mei, 5th Floor, No. 28, Alley 401, Lane 150, Hsin I Road, Sec. 5, Taipei City (TW)

( * ) Notice: Subject to any disclaimer, the term of this patent is extended or adjusted under 35 U.S.C. 154(b) by 0 days.

(21) Appl. No.: 11/808,428

(22) Filed: Jun. 11, 2007

(65) Prior Publication Data

US 2008/0305693 A1 Dec. 11, 2008

(51) Int. Cl.
*H01R 25/00* (2006.01)

(52) U.S. Cl. ..... 439/652; 439/11; 439/651; 200/51 R

(58) Field of Classification Search ..... 439/651, 439/11, 13, 652; 200/51 R, 51.07, 51.12
See application file for complete search history.

(56) References Cited

U.S. PATENT DOCUMENTS 4,875,152 A * 10/1989 Foster ..... 363/146
5,334,033 A * 8/1994 Milan ..... 439/214
5,775,921 A * 7/1998 Chou ..... 439/21
5,997,310 A * 12/1999 Chiu et al. ..... 439/21
6,045,399 A * 4/2000 Yu ..... 439/502
6,750,410 B2 * 6/2004 Lee ..... 200/51.03
6,979,220 B1 * 12/2005 Ray et al. ..... 439/346

* cited by examiner

*Primary Examiner*—Briggitte R Hammond
*Assistant Examiner*—Vanessa Girardi
(74) *Attorney, Agent, or Firm*—Rosenberg, Klein & Lee

(57) ABSTRACT

A tandem-connected rotatable receptacle unit is provided. The unit includes a primary receptacle having a housing, an electric plug with an electric cord disposed at the front end of the housing, and a first slot set formed at the rear side of the primary receptacle for the output of power. The unit further includes at least one tandem connection receptacle having a blade set at the front side of the housing, the blade set being fixed at a round seat. The blades of the blade set are each coupled to a conducting wire electrically coupled to a conducting piece of a first slot set at the rear end of the tandem connection receptacles. The tandem connection receptacle further includes a second slot set at a side wall and a projecting rib provided at the circumference of the round seat, whereby the round seat can be rotated about the round seat for adjusting the direction of a second slot set at the side wall of the housing.

7 Claims, 13 Drawing Sheets

TANDEM-CONNECTED ROTATABLE RECEPTACLE UNIT

BACKGROUND OF THE INVENTION

1. Field of the Invention

The present invention relates to a receptacle, and more particularly to a receptacle that permits an independent use or a tandem connection to be a multiple socket board. Moreover, the slots in the individual receptacles are rotatable for adjusting the direction thereof.

2. Description of the Related Art

When a building is complete, a wall socket (receptacle) is installed on a wall at a prearranged place. However, the household appliances are various and distributed indoors at different places. As a result, it is not easy for them to obtain access to power source. Therefore, a socket board with an extension cable is an indispensable electric element for the daily life. With the rapid development of the 3C products, such as computer/communication/consumer electronics, the personal desires are also inspired. To take a personal computer as an example, the host, monitor, printer, scanner, etc. all require power to perform their operations. Thus, a multiple socket board with more and more sockets is developed for meeting different requirements.

Referring to FIGS. 1 and 2, in which a perspective view of a conventional two-slot and three-slot extension cable 40, 50 with a multiple socket board is shown, the sockets (receptacles) are arranged in a fixed structure. In other words, the slots of the socket board are immovably disposed in the same direction. As a result, the adjustment of the direction of the slots is not possible for the conventional socket board.

In the daily life, the electric household appliances are placed in different locations. It often happens that the cable is not in line with the blades of the plug when inserted into the slots. For example, an angle of 90° can even take place. For an extreme case, a dead angle will be created when the direction of the slots of the socket board is non-adjustable. Moreover, the head of some adapters is so big that the adjacent slots are occupied as well. Therefore, it's much unpractical for the inserting action. That is, the plug and the electric cord are undesirably twisted. For a serious case, the power cords of different household appliances are cluttered such that the user can be considerably bothered.

Another problem of the above-mentioned fixed type extension cable with a multiple socket is that an unnecessary space is occupied when the user requires only one socket and the other five or more sockets are not detachable. Thus, this requires further improvements.

SUMMARY OF THE INVENTION

It is a primary object of the invention to provide a tandem connection type receptacle unit having several slots according to different requirements. Meanwhile, the individual receptacles can be tandem-connected in a longitudinal and a transverse direction according to the environment and location, thereby occupying the least space and achieving the convenient use.

It is another object of the invention to provide a rotatable receptacle unit having independent receptacles that can be tandem-connected in a longitudinal and a transverse direction. Meanwhile, the receptacles can be rotated in various directions like upward, downward, rightward, and leftward. In this way, it can be avoided that the blade sets or the adapter heads interfere with each other or occupy the adjacent slots. Accordingly, all of the slots can be used without any problems.

In order to achieve the above-mentioned objects, a tandem-connected rotatable receptacle unit includes:

a) a primary receptacle having a housing, an electric plug with an electric cord being disposed at the front end of the housing for obtaining power to enable the function of the primary receptacle, a first slot set being formed at the rear side of the primary receptacle for the output of power; and b) at least one tandem connection receptacle, the tandem connection receptacles each having a blade set at the front side of the housing for an electric plug-in connection to the first slot set of the primary receptacle, the blade set being fixed at a round seat, the internal end thereof being disposed within the housing, the blades of the blade set each being connected with a conducting wire, respectively, the conducting wires each being electrically coupled to a conducting piece of a first slot set at the rear end of the tandem connection receptacles, the tandem connection receptacle further having a second slot set at a side wall perpendicular to the first slot set, a projecting rib being provided at the circumference of the round seat and fitting into an annular groove at the corresponding place of the housing, whereby the round seat can be rotated about the round seat in a forward or reverse direction for adjusting the direction of a second slot set at the side wall of the housing.

BRIEF DESCRIPTION OF THE FIGURES

The accomplishment of this and other objects of the invention will become apparent from the following descriptions and its accompanying figures of which.

DETAILED DESCRIPTION OF THE PREFERRED EMBODIMENT

Figure 1:
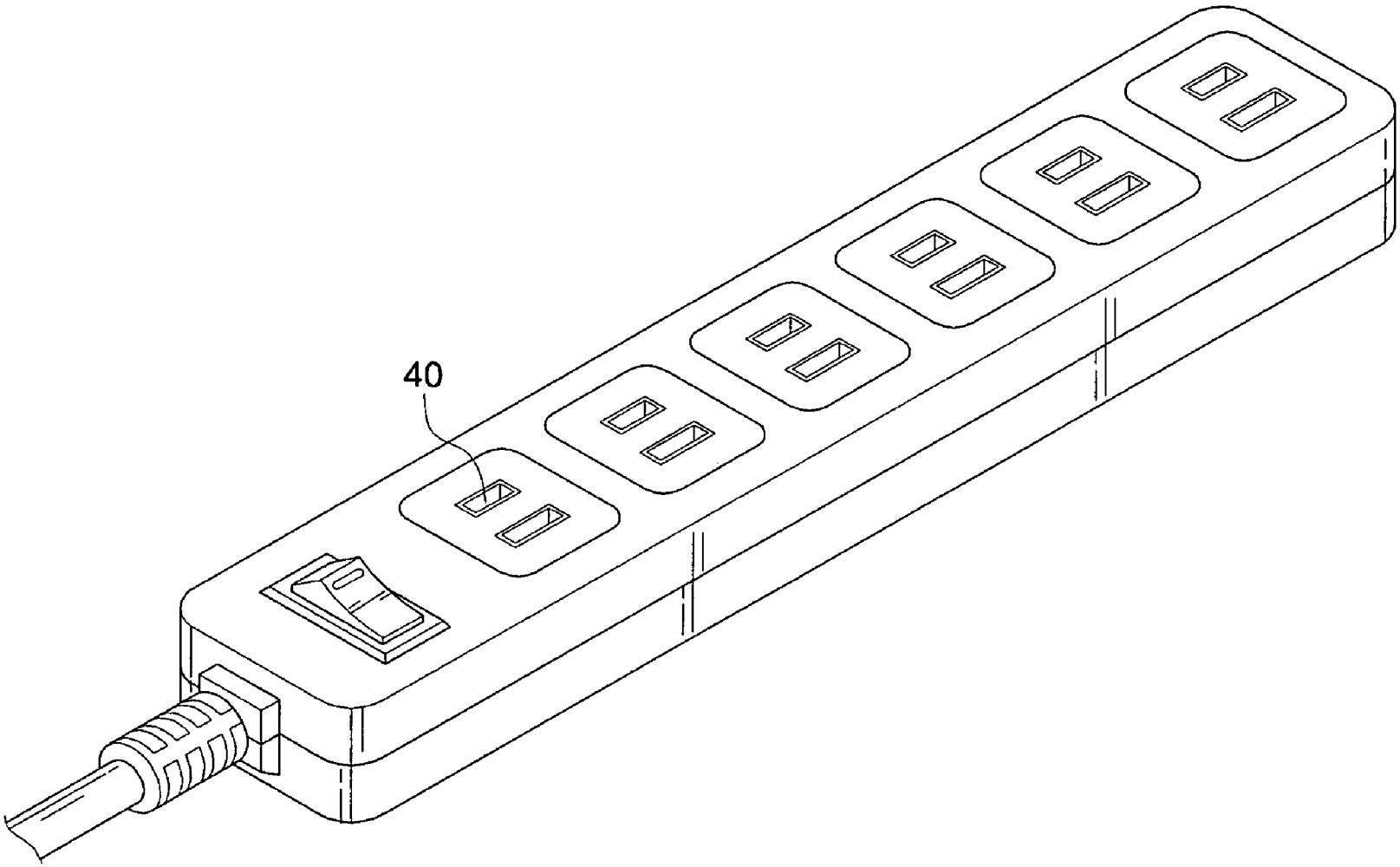
FIG.1 (PRIOR ART)
FIG. 1 is a perspective view of a two-slot extension cable with a multiple socket board.
Figure 2:
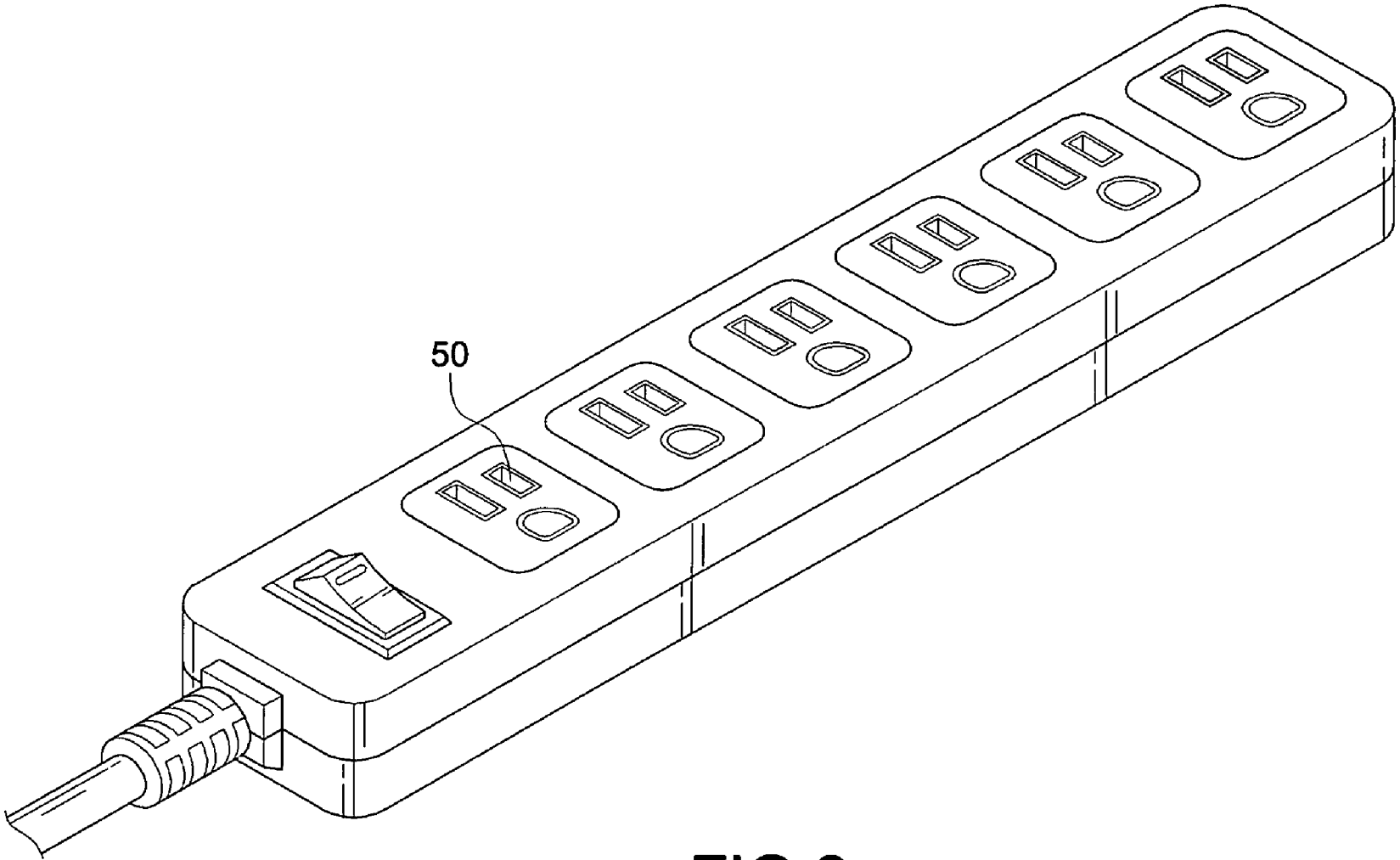
FIG.2 (PRIOR ART)
FIG. 2 is a perspective view of a three-slot extension cable with a multiple socket board.
Figure 3:
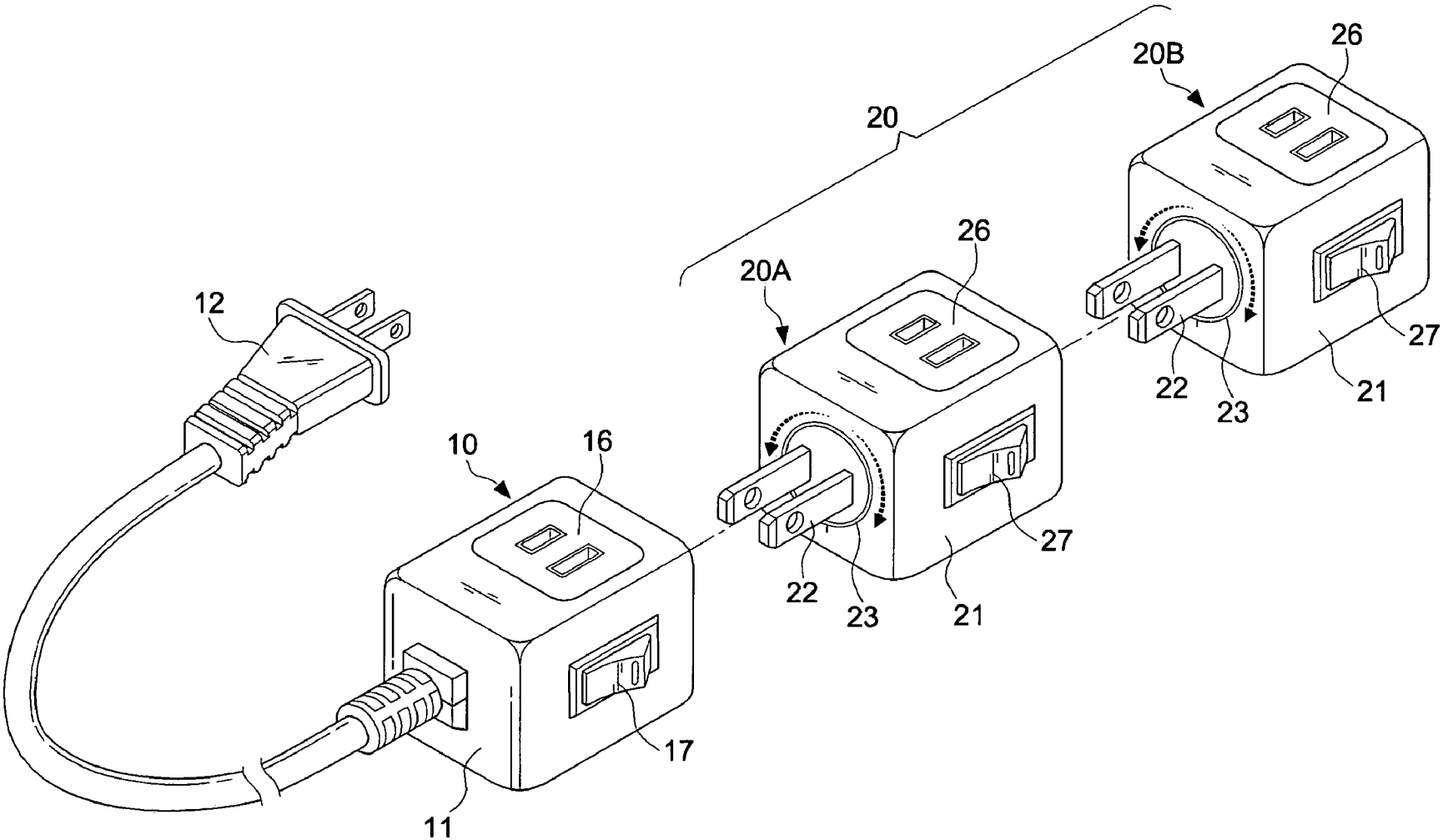
FIG. 3 is an exploded perspective view of a preferred embodiment of the invention.
Figure 4:
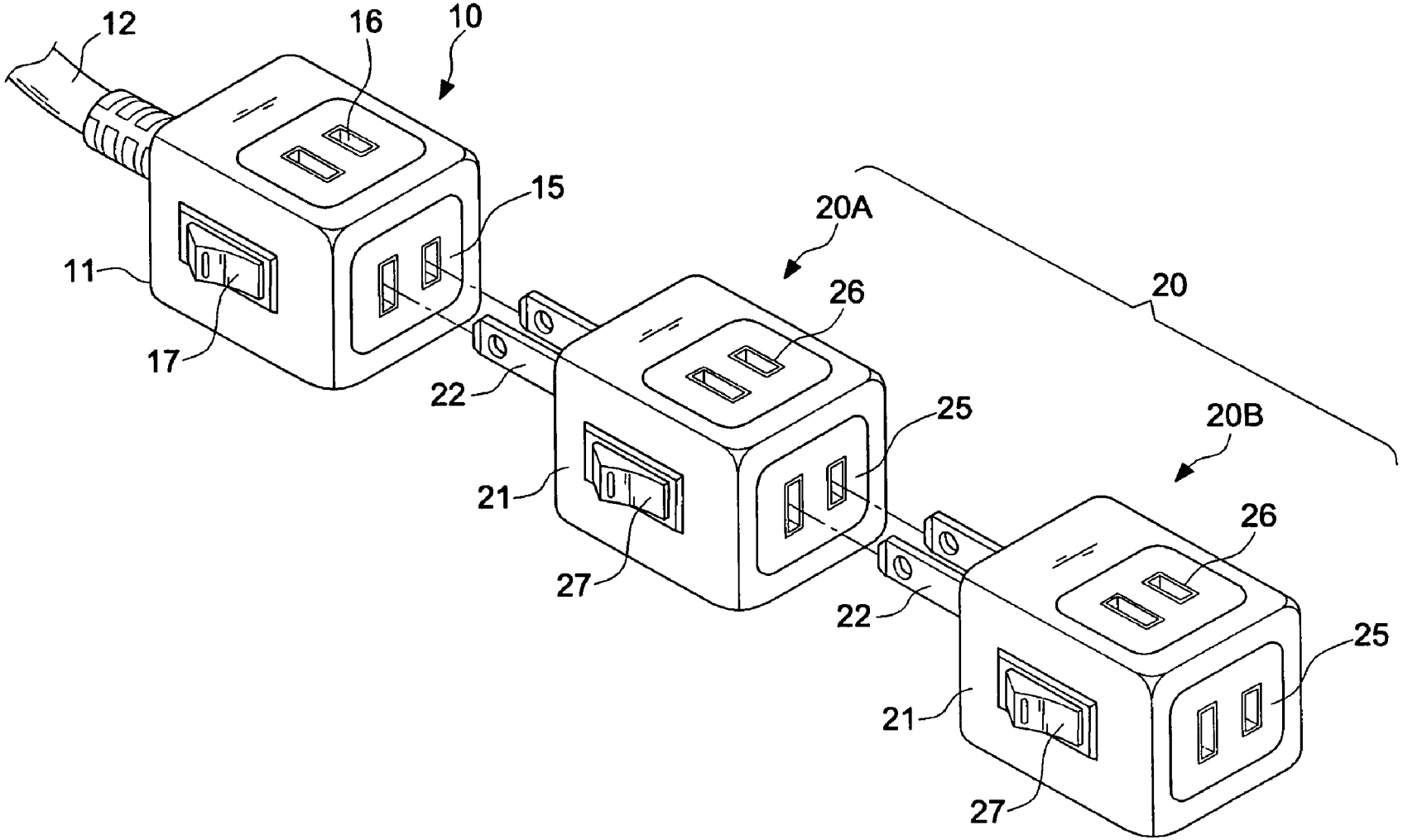
FIG. 4 is an exploded perspective view of the preferred embodiment of FIG. 3 seen from the other side.

Referring to FIGS. 3 and 4, a preferred embodiment of the invention includes a primary receptacle 10 and at least one tandem connection receptacle 20A, 20B, 20C, 20D, etc.

The primary receptacle 10 includes a housing 11. An electric plug 12 with an electric cord is disposed at the front end of the housing 11 for obtaining power to enable the function of the primary receptacle 10. A first slot set 15 is formed at the rear side of the primary receptacle 10 for the output of power. According to the embodiment, the electric plug 12 has two blades while the first slot set 15 includes two slots. However, it should not be restricted thereto. In other words, three blades and three slots are also possible.

All of the tandem connection receptacles 20A, 20B, 20C, 20D have the same structure. The number of the tandem connection receptacles is variable according to different requirements to form a complete two-slot tandem connection receptacle assembly 20. The tandem connection receptacles 20A, 20B each have a blade set 22 at the front side of the housing 21 for an electric plug-in connection to the first slot set 15 of the primary receptacle 10. Also, referring to FIGS. 8A, 8B, 9A and 9B, the blade set 22 is fixed at a round seat 23, and the internal end thereof is disposed within the housing 21. The blades of the blade set 22 are connected with a conducting wire 24, respectively. Each of the conducting wires 24 is electrically coupled to a conducting piece 251 of a first slot set 25 at the rear end of the tandem connection receptacles 20A. The conducting wire 24 in accordance with the invention is preferably twisted into a coiled shape. The coiled shape of the conducting wire 24 ensures a sufficient length of the conducting wire 24 and prevents the conducting wire 24 from the improper pulling action when the housing 21 is rotated about the round seat 23. In order to facilitating the rotation of the housing 21 about the round seat 23, a projecting rib 231 is provided at the circumference of the round seat 23 and fits into an annular groove 211 at the corresponding place of the housing 21. In this way, the round seat 23 can be rotated about the round seat 23 in a forward or reverse direction for adjusting the direction of a second slot set 26 at the side wall of the housing 21. The number of the second slot set 26 is not restricted to only one set. However, it's preferable to dispose the second slot set 26 at a side wall perpendicular to the first slot set 25.

Again, referring to FIGS. 8A, 9A, and 9B, a positioning piece 233 smaller than the height of the annular groove 232 of the projecting rib 231 is formed at an external circumference of the round seat 23 of the tandem connection receptacles 20A, 20B, 20C, 20D. The housing 21 includes a lug 212 at the corresponding internal rim thereof. Accordingly, the lug 212 is rotatable in the annular groove 232, but not about 360°. Accordingly, the rotating range thereof is restricted for preventing the conducting wire 24 inside from being twisted off.

Referring to the above-mentioned drawings, the tandem connection receptacles 20A, 20B, 20C, 20D further includes an on-off switch 27 to control the connection or disconnection of the second slot set 26 and the conducting wire 24. This design is intended to control the power of the second slot set 26. As shown in FIG. 8B, the blade set 22 is inserted into the first slot set 25 to establish the electric connection when the tandem connection receptacles 20A, 20B . . . are connected to one another. In this way, a similar structure similar to the conventional multiple socket board is created. Actually, the one to supply power to the household appliances is the second slot set 26. That is, all of the second slot sets 26 are connected in parallel so that they obtain the same voltage. When not in use, the on-off switch 27 is intended to disconnect the second slot set 26 from the power source. When in use, a contact 271 of the on-off switch 27 is brought in contact with a contact 261 of the second slot set 26 for establishing the electric connection. As a result, the use safety can be guaranteed.

In addition that the tandem connection receptacles has the second slot set 26 and the on-off switch 27, it's also possible to provide a second slot set 16 and an on-off switch 17 for the primary receptacle 10. The on-off switch 17 is disposed on a conducting strip 14 between a wire 13 and the first slot set 15. This belongs to the prior art so that no further descriptions thereto are given hereinafter.

Figure 5:
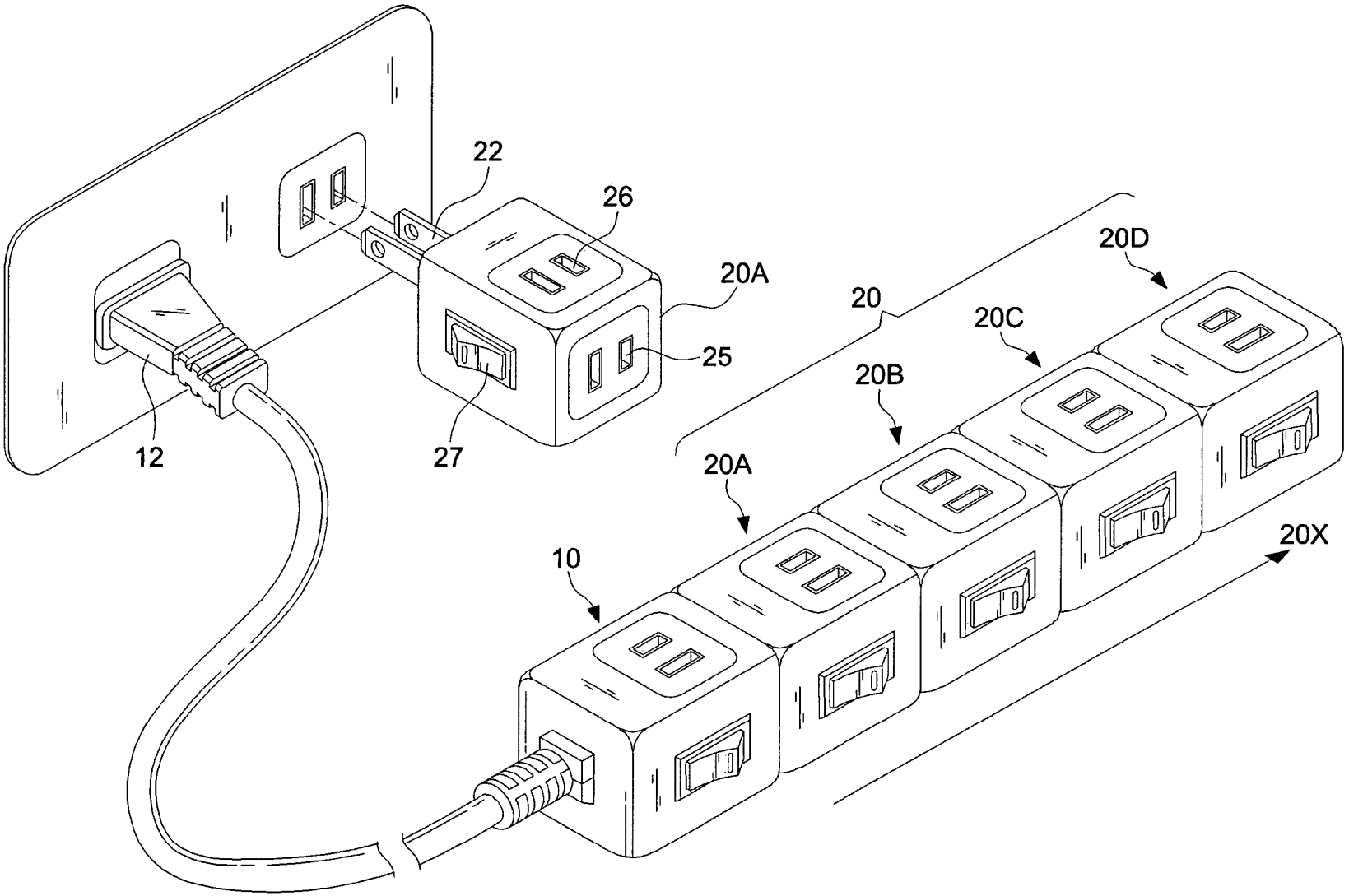
FIG. 5 is a perspective view of a first application example of the invention.
Figure 6:
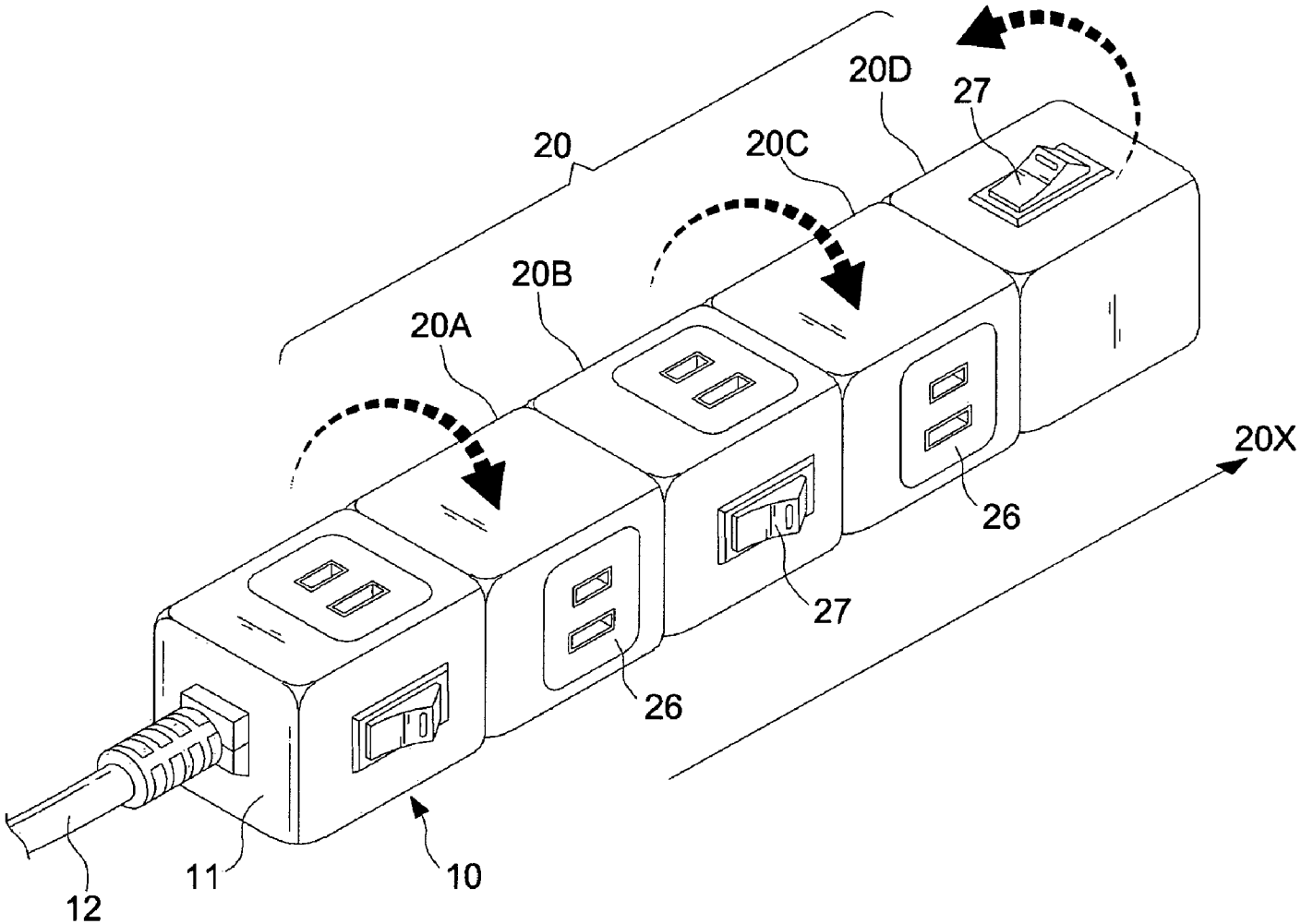
FIG. 6 is a perspective view of a second application example of the invention.
Figure 7:
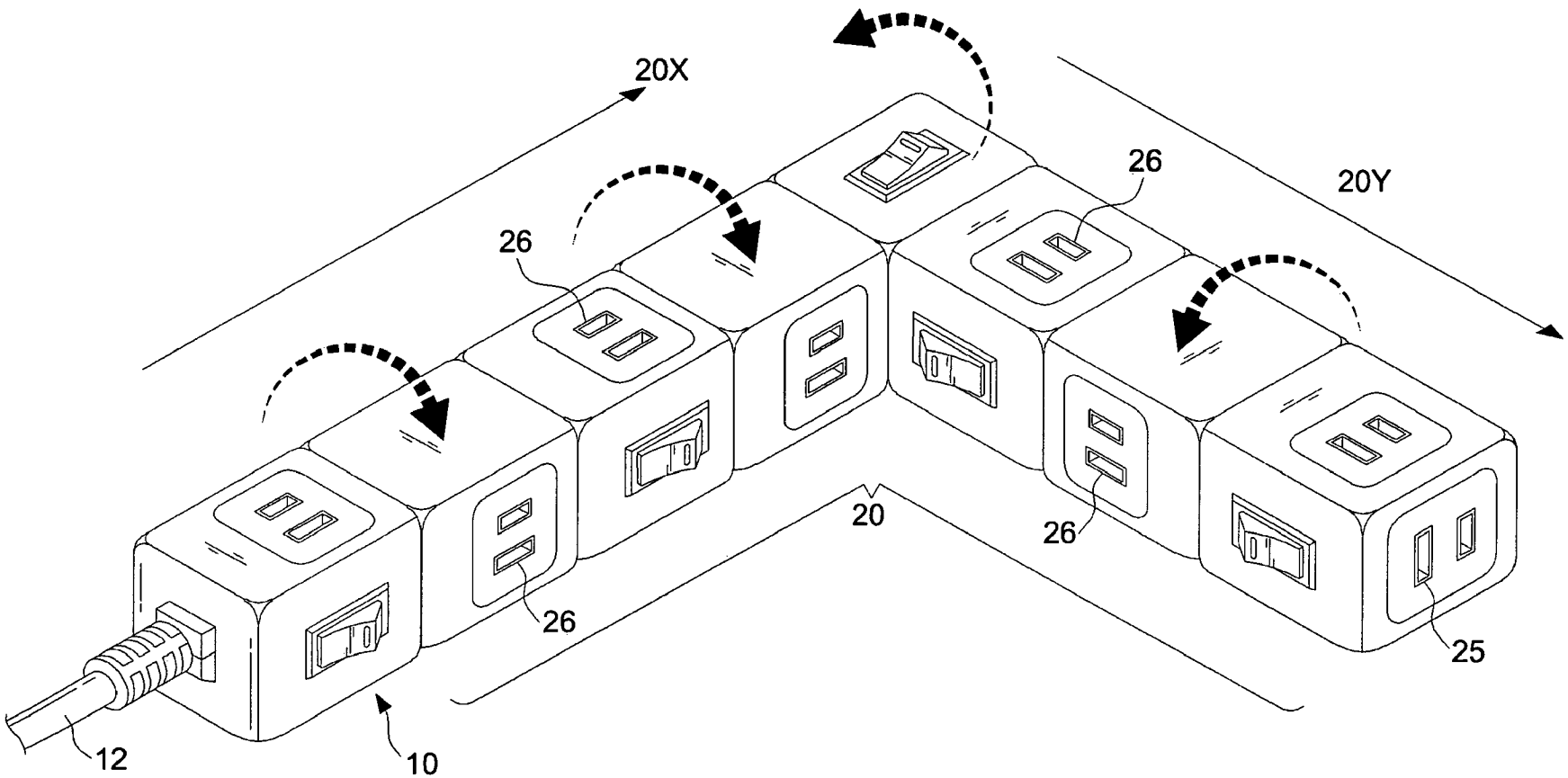
FIG. 7 is a perspective view of a third application example of the invention.
Figure 8A:
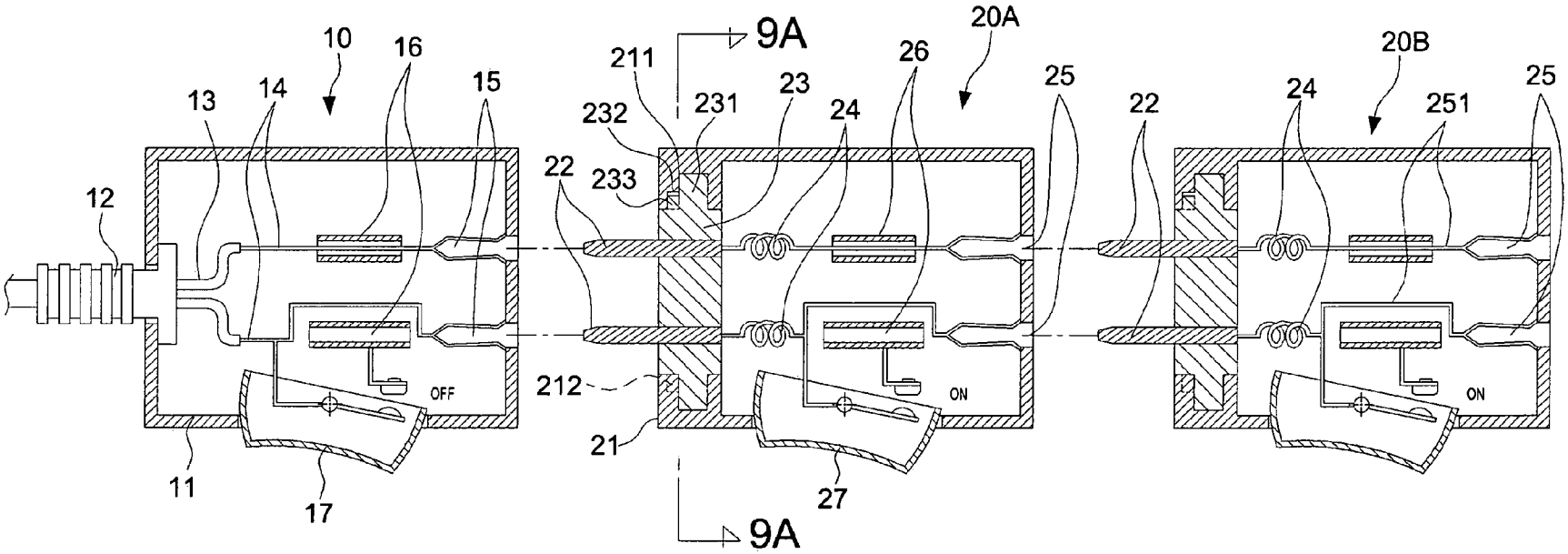
FIG. 8A is an axial sectional view of the preferred embodiment of the invention in a detached state.
Figure 8:
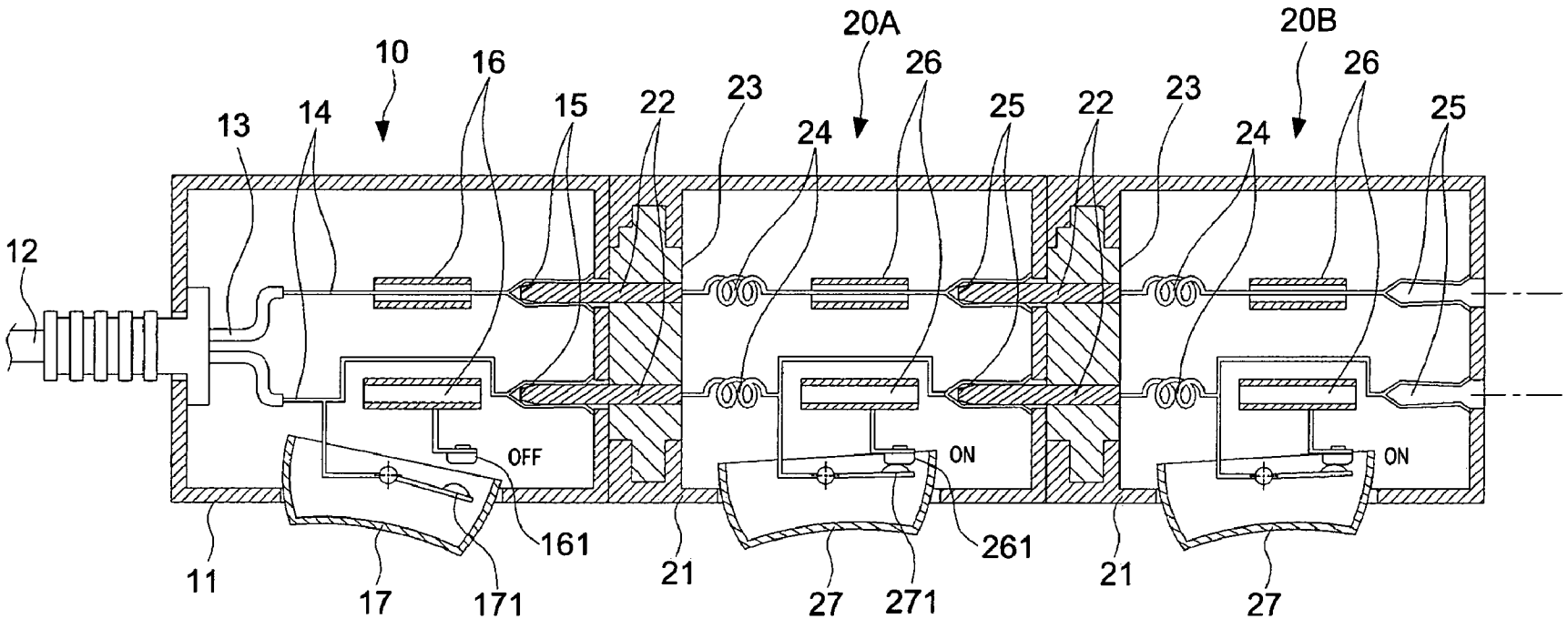
FIG. 8B is an axial sectional view of the preferred embodiment of the invention in an assembly state.
Figure 9:
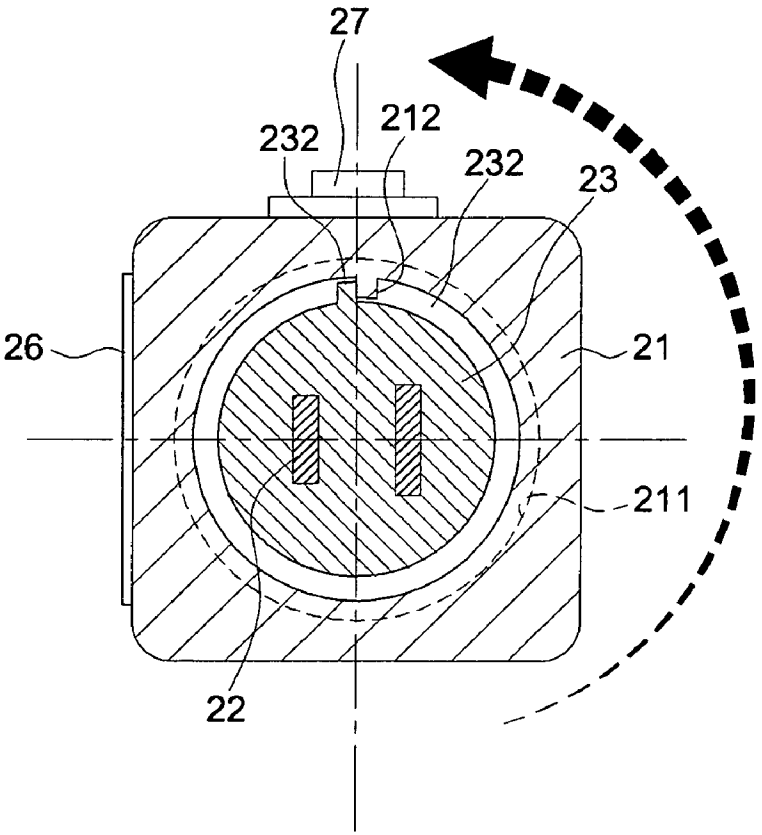
FIG. 9A is an radial sectional view taken along line 9A-9A of FIG. 8A.
FIG. 9B is an radial sectional view showing the rotation of the housing according to FIG. 9A.
Figure 9:
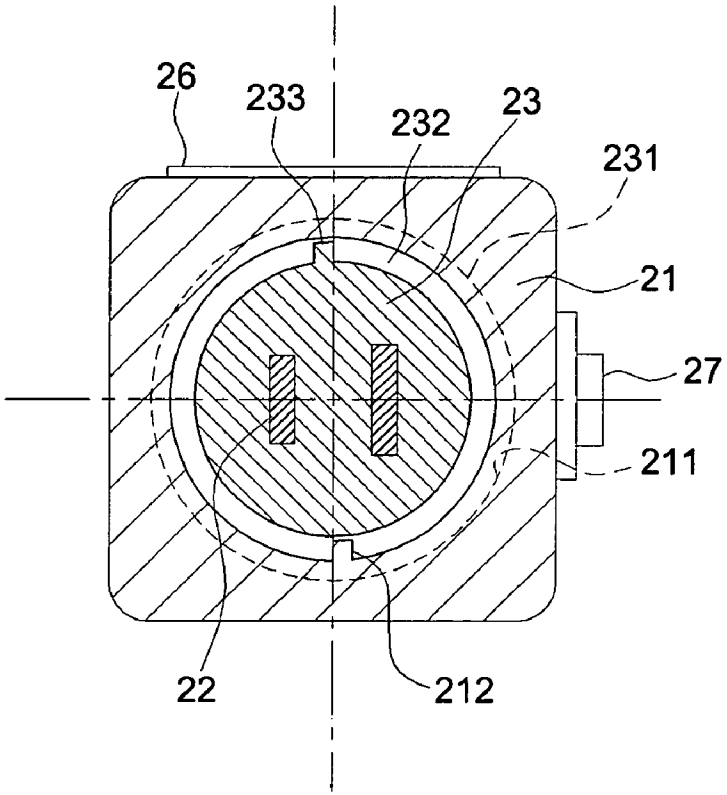
Figure 10:
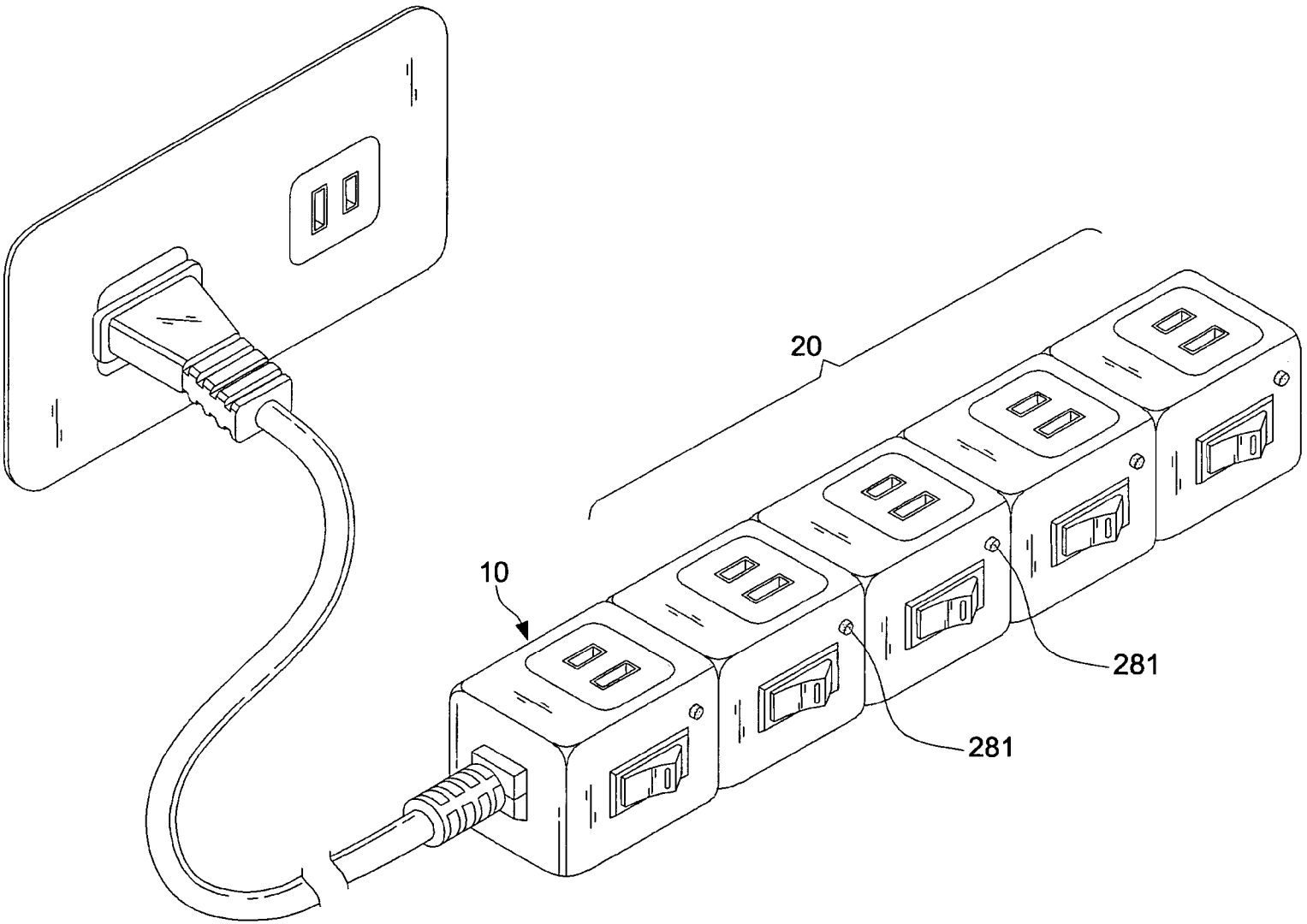
FIG. 10 is a perspective view of another embodiment of the invention.
Figure 11:
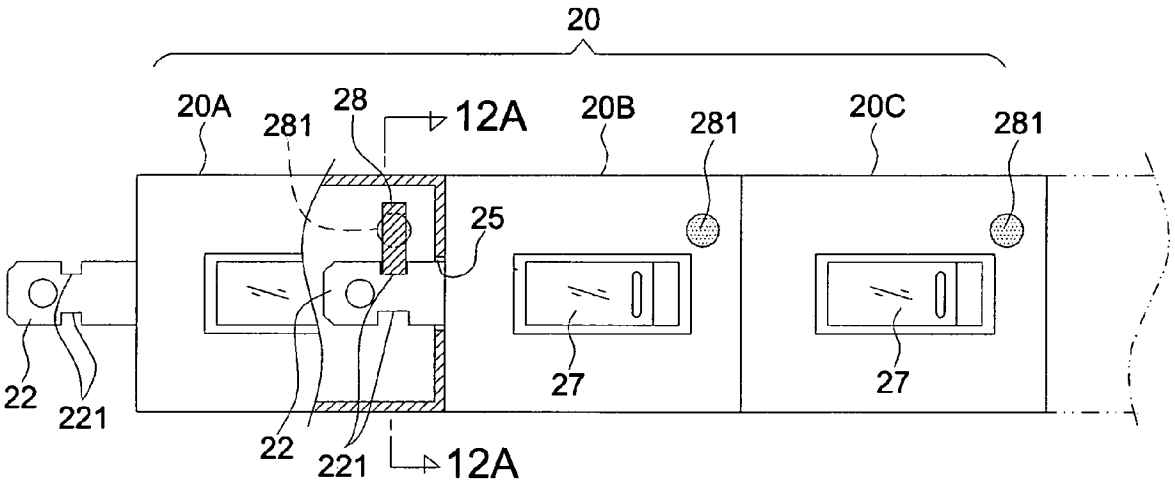
FIG. 11 is a partial axial sectional view of the embodiment of FIG. 10.
Figure 12B:
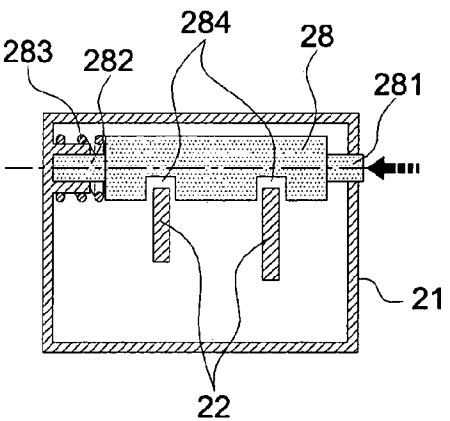
FIG. 12B is an radial sectional view showing a transverse locking pin of FIG. 12A in an unlocked state.
Figure 12A:
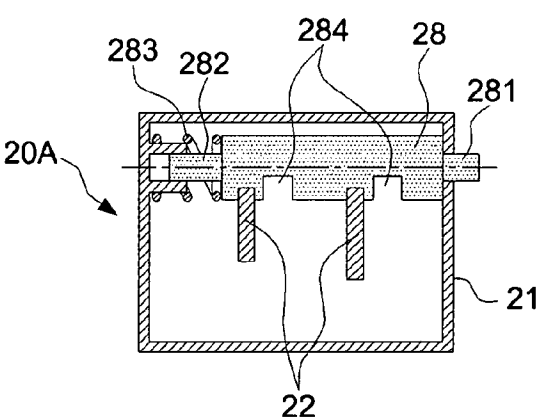
FIG. 12A is an radial sectional view taken along line 12A-12A of FIG. 11.

Referring back to FIGS. 5 through 7, the tandem connection receptacles 20A, 20B, 20C, 20D of the two-slot tandem connection receptacle assembly 20 can be coupled together either in longitudinal direction 20X or in lateral direction 20Y to created a socket board. Meanwhile, the direction thereof is so adjustable that the second slot sets 26 are disposed in a staggered way so as to facilitate the insertion of the plug of the electric appliances. When not in use, the tandem connection receptacles 20A, 20B, 20C, 20D can be detached from one another for a practical storage. As shown in FIG. 5, a single tandem connection receptacle 20A can be inserted into an indoor wall socket as well for achieving a convenient and practical use.

Referring to FIGS. 10, 11, 12A, and 12B, in which another embodiment of the invention is shown, the tandem connection receptacle 20A further includes a transverse locking pin 28 provided within the first slot set 25. One end of the transverse locking pin 28 projects from one side wall of the housing 21 to create a push-button portion 281. Another end 282 is disposed within the housing 21 and a spring 283 is mounted on the end 282 of the transverse locking pin 28. The transverse locking pin 28 includes two n-shaped indentations 284 corresponding to the blade set 22. Besides, an engaging groove 221 is formed at the top and bottom ends of the blade set 22 corresponding to the transverse locking pin 28. When the tandem-connected blade sets 22 are inserted into the first slot sets 25, the two n-shaped indentations 284 are located beside the blade set 22 due to the influence of the resilience of the spring 283 in such a way that the transverse locking pins 28 are engaged into the engaging grooves 221 of the blade sets 22 (see FIG. 11). In this way, the tandem-connected receptacles are locked to one another without worrying about loosening. In detaching the tandem-connected receptacles, the push-button portion 281 is compressed by a finger in such a manner that the blade sets 22 are just engaged into the n-shaped indentations 284 of the transverse locking pin 28 (see FIG. 12B). Accordingly, an unlocked effect is achieved.

Figure 13:
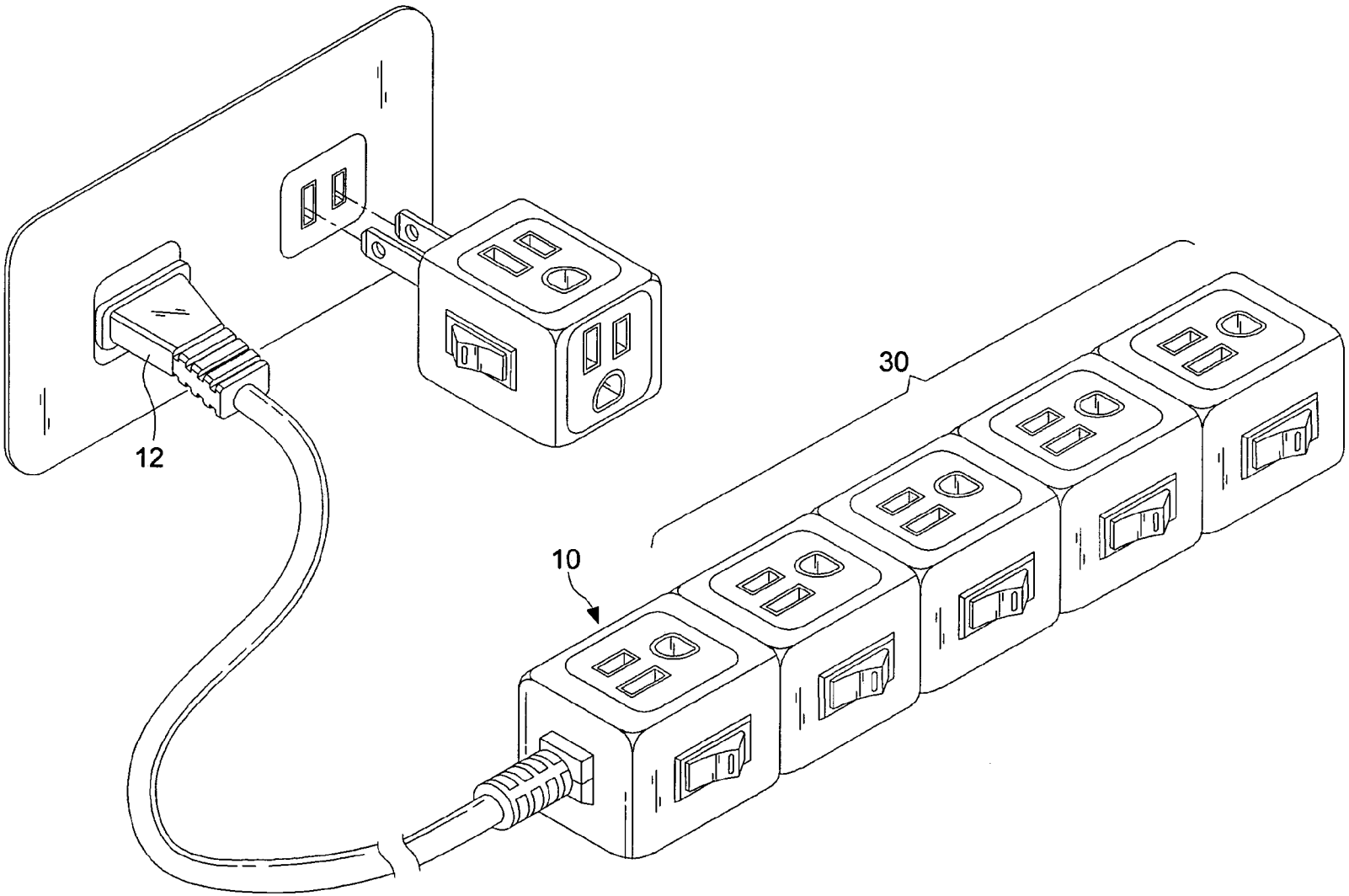
FIG. 13 is a perspective view of an embodiment of a three-slot tandem connection receptacle in accordance with the invention.

Referring to FIG. 13, in which another applicable embodiment of the invention is shown, the slot set 26 has three slots for meeting requirements in different countries. In this way, a three-slot tandem connection receptacle assembly 30 is created. The difference lies only in that the number of the conducting blades and the slots is different. The tandem connection principles and the rotating structure are identical to the above-mentioned embodiment so that no further descriptions thereto are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A tandem-connected rotatable receptacle unit, comprising:

a) a primary receptacle having a housing, an electric plug with an electric cord being disposed at a front end of the housing for obtaining power to enable the function of the primary receptacle, a first slot set being formed at a rear side of the primary receptacle for the output of power; and b) at least one tandem connection receptacle, the tandem connection receptacles each having a blade set at a front side of a housing for an electric plug-in connection to the first slot set of the primary receptacle, the blade set being fixed within a round seat, such that an internal end thereof is disposed within the housing, the blades of the blade set each being coupled to a conducting wire, the conducting wires each being electrically coupled to a conducting piece of a first slot set at a rear end of the tandem connection receptacles, the tandem connection receptacle further having a second slot set at a side wall perpendicular to the first slot set, a projecting rib being provided at a circumference of the round seat and fitting into an annular groove at the corresponding place of the housing, whereby the round seat is reversibly rotatable for adjusting the second slot set at the side wall of the housing in orientation;

wherein the tandem connection receptacle further includes a transverse locking pin provided within the first slot set, and wherein one end of the transverse locking pin projects from one side wall of the housing to create a push-button portion, and wherein another end is disposed within the housing and a spring is mounted on the end of the transverse locking pin, and wherein the transverse locking pin includes two n-shaped indentations corresponding to the blade set, and wherein an engaging groove is formed at a top end and a bottom end of the blade set corresponding to the transverse locking pin, and wherein, when the tandem-connected blade sets are inserted into the first slot sets, the two n-shaped indentations are located beside the blade set due to the influence of the resilience of the spring in such a way that the transverse locking pins are engaged into the engaging grooves of the blade sets so that the tandem-connected receptacles are locked to one another.

2. The tandem-connected rotatable receptacle unit as recited in claim 1, wherein the tandem connection receptacles further includes an on-off switch to control the connection or disconnection between the second slot set and the conducting wire.

3. The tandem-connected rotatable receptacle unit as recited in claim 1, wherein the tandem connection receptacles are coupled together either in a front to rear longitudinal direction or in front to side lateral direction.

4. The tandem-connected rotatable receptacle unit as recited in claim 1, wherein the conducting wire coupled to the blade set is twisted into a coiled shape.

5. The tandem-connected rotatable receptacle unit as recited in claim 1, wherein a positioning piece formed to project from the round seat of the tandem connection receptacles for restricting the rotation of the housing within a range of 360°.

6. The tandem-connected rotatable receptacle unit as recited in claim 1, wherein the primary receptacle further includes a second slot set and an on-off switch.

7. The tandem-connected rotatable receptacle unit as recited in claim 1, wherein each slot set of the primary receptacle and the tandem connection receptacles have two or three slots.

* * * * *